US011447914B2

(12) United States Patent
Basilio et al.

(10) Patent No.: US 11,447,914 B2
(45) Date of Patent: Sep. 20, 2022

(54) REMOVAL OF STICKIES IN THE RECYCLING OF PAPER AND PAPERBOARD

(71) Applicant: Thiele Kaolin Company, Sandersville, GA (US)

(72) Inventors: Cesar I. Basilio, Milledgeville, GA (US); Steven W. Sheppard, Sandersville, GA (US)

( * ) Notice: Subject to any disclaimer, the term of this patent is extended or adjusted under 35 U.S.C. 154(b) by 624 days.

(21) Appl. No.: 15/834,497

(22) Filed: Dec. 7, 2017

(65) Prior Publication Data

US 2019/0177913 A1 Jun. 13, 2019

(51) Int. Cl.

| | |
|---|---|
| ***D21H 21/02*** | (2006.01) |
| ***D21C 5/02*** | (2006.01) |
| ***D21J 1/00*** | (2006.01) |
| ***D21H 11/14*** | (2006.01) |
| ***D21C 9/08*** | (2006.01) |

(52) U.S. Cl.

CPC ..... *D21C 5/022* (2013.01); *D21C 9/08* (2013.01); *D21H 11/14* (2013.01); *D21H 21/02* (2013.01); *D21J 1/00* (2013.01)

(58) Field of Classification Search

CPC combination set(s) only.
See application file for complete search history.

(56) References Cited

U.S. PATENT DOCUMENTS

| | | | |
|---|---|---|---|
| 1,421,195 | A | 6/1922 | Eyrich et al. |
| 3,764,460 | A | 10/1973 | Miyamoto et al. |
| 4,013,505 | A | 3/1977 | Balcar et al. |
| 4,360,439 | A | 11/1982 | Calmanti et al. |
| 4,421,195 | A | 12/1983 | Aiba |
| 4,483,741 | A | 11/1984 | Maloney et al. |
| 4,605,773 | A | 8/1986 | Maloney et al. |
| 4,886,575 | A | 12/1989 | Moreland |
| 4,923,566 | A | 5/1990 | Shawki et al. |
| 4,956,051 | A | 9/1990 | Moreland |
| 4,964,949 | A | 10/1990 | Hamaguchi et al. |
| 5,080,759 | A | 1/1992 | Buzby et al. |
| 5,151,155 | A | 9/1992 | Cody et al. |
| 5,225,046 | A | 7/1993 | Borchardt |
| 5,227,019 | A | 7/1993 | Borchardt |
| 5,288,369 | A | 2/1994 | Ishibashi et al. |
| 5,308,448 | A | 5/1994 | Behler et al. |
| 5,336,372 | A | 8/1994 | Cody et al. |
| 5,362,363 | A | 11/1994 | Smolka et al. |
| 5,540,814 | A | 7/1996 | Curtis et al. |
| 5,725,730 | A | 3/1998 | Smolka et al. |
| 5,736,622 | A | 4/1998 | Wallberg et al. |
| 5,798,023 | A | 8/1998 | Pruszynski et al. |
| 5,801,135 | A | 9/1998 | Miyauchi et al. |
| 5,882,476 | A | 3/1999 | Evans et al. |
| 6,013,157 | A | 1/2000 | Li et al. |
| 6,103,687 | A | 8/2000 | Cody et al. |
| 6,136,994 | A | 10/2000 | Joseph et al. |
| 6,159,381 | A | 12/2000 | Bleakley et al. |
| 6,210,526 | B1 | 4/2001 | Pohlen |
| 6,251,220 | B1 | 6/2001 | Irinatsu et al. |
| 6,458,343 | B1 | 10/2002 | Zeman et al. |
| 6,471,826 | B2 | 10/2002 | Glover et al. |
| 7,862,685 | B2 | 1/2011 | Rosencrance et al. |
| 8,048,268 | B2 | 4/2011 | Jiang et al. |
| 8,043,473 | B2 | 10/2011 | Yuzawa et al. |
| 8,052,837 | B2 | 11/2011 | Basilio et al. |
| 8,388,806 | B2 | 3/2013 | Gu et al. |
| 8,691,052 | B2 | 4/2014 | Zhang et al. |
| 8,784,606 | B2 | 7/2014 | Kohler et al. |
| 8,784,613 | B2 | 7/2014 | Bryant et al. |
| 8,815,051 | B2 * | 8/2014 | Basilio ..... D21C 5/02 162/109 |
| 8,840,761 | B2 | 9/2014 | Woiceshyn |
| 9,017,519 | B2 | 4/2015 | Buri et al. |
| 9,057,155 | B2 | 6/2015 | Kohler et al. |
| 2002/0059998 | A1 * | 5/2002 | Glover ..... D21H 21/02 162/72 |
| 2002/0066880 | A1 | 6/2002 | Robinson et al. |
| 2004/0065419 | A1 | 4/2004 | Lasmarias et al. |
| 2005/0098278 | A1 | 5/2005 | Rosencrance et al. |
| 2005/0133172 | A1 | 6/2005 | Robinson et al. |

(Continued)

FOREIGN PATENT DOCUMENTS

| | | |
|---|---|---|
| JP | 61-266688 | 11/1986 |
| JP | 05-501285 | 3/1993 |

(Continued)

OTHER PUBLICATIONS

Drelich et al., Interfacial Chemistry Aspects of De-Inking Flotation of Mixed Office Paper; Paper presented at the Annual Meeting of the Society of Mining, Metallurgy and Exploration, in Denver, Colorado during Feb. 26-28, 2001.

Horeck & Luo,Advances in Deinking Surfactant Chemistry for Onp/Omg Systems; Paper Age Magazine; Jul. 2001 issue.

Smook, Handbook for Pulp & Paper Technologists; 2nd Edition; Angus Wilde Publications; 1992; p. 227.

Murray, "Overview-clay mineral applications", Applied Clay Science, vol. 5, pp. 379-395; 1991.

Janczuk et al., "Influence of Exchangeable Cations . . . ", Clays and Clay Minerals, vol. 37, No. 3. pp. 269-272; 1989.

Chiang et al., "Interfacial Properties of Lignite, Graphite, Kaolin, and Pyrite", ACS Fuels Symposium (Los Angeles), vol. 33, No. 4, pp. 777-788; 1988.

(Continued)

*Primary Examiner* — Jacob T Minskey
(74) *Attorney, Agent, or Firm* — Baker Donelson

(57) ABSTRACT

Removal of stickies from waste paper and paperboard is obtained with the use of a modified kaolin-based stickies removal composition. The modified kaolin-based stickies removal composition is produced by modifying the kaolin clay, separating the modified kaolin clay from the non-reactive kaolin clay, and then adding a nonionic surfactant to the modified kaolin-based particles. Removal of stickies is improved by the use of this modified kaolin-based stickies removal composition during the recycling of the waste paper and paperboard.

9 Claims, No Drawings

(56) References Cited

U.S. PATENT DOCUMENTS

| | | | | |
|---|---|---|---|---|
| 2007/0158039 | A1 | 7/2007 | Rosencrance et al. | |
| 2012/0031573 | A1* | 2/2012 | Basilio | D21C 5/02 162/5 |
| 2016/0177505 | A1* | 6/2016 | Laser | C09D 175/02 162/199 |

FOREIGN PATENT DOCUMENTS

| | | |
|---|---|---|
| JP | 05-501286 | 3/1993 |
| JP | 10-88489 | 4/1998 |
| JP | 11-240713 | 9/1999 |
| WO | 9105905 | 5/1991 |

OTHER PUBLICATIONS

Willis et al., "Kaolin Flotation: Beyond the Classical", Advances in Flotation Technology, Society for Mining, Metallurgy, and Exploration, Inc., pp. 219-229 (1999)—cited by other.

Palomino et al., "Mixtures of Fine-Grained Minerals—Kaolinte and Carbonate Grains", Clays and Clay Minerals, vol. 56, No. 6, pp. 599-611; 2008.

Wang et al, "A Study of Carrier Flotation", International Symposium on Fine Particles Processing (Las Vegas), American Institute of Mining . . . , Inc., p. 1112-1128; 1980.

* cited by examiner

REMOVAL OF STICKIES IN THE RECYCLING OF PAPER AND PAPERBOARD

TECHNICAL FIELD

The present invention relates to the removal of stickies from waste paper and paperboard. In a more specific aspect, this invention relates to the use of a modified kaolin-based composition for the removal of stickies from waste paper and paperboard.

BACKGROUND OF THE INVENTION

The recovered fiber from waste paper and paperboard such as old newspaper (ONP), old magazine (OMG), mixed office waste (MOW), sorted white ledger (SWL), sorted office paper (SOP), and old corrugated carton (OCC) has become a principal source of raw material for making paper in the US and Europe, with significant growth in China and other Asian countries. Although the production of recycled newsprint and printing paper has been significantly reduced in the US and Europe, those of recycled tissue, brown and paperboard grades have continued to grow.

One of the current issues in paper recycling is the quality of the recovered paper and paperboard. With single stream recycling being more common now, the quality of the recovered paper and paperboard has been getting poorer. It has also resulted in stickies issues being more prevalent in paper recycling operations. In the paper industry, stickies refers to a mixture of organic contaminants used to join the paper substrate to other materials. This includes adhesives, hot melts, wax, coating binders, wood resins, rosins, and wet strength resins. The problem of stickies is now a global issue that affects recycling all types of paper and paperboard. Stickies deposit on machine surfaces, fabrics, wires, felts and rolls, which leads to machine breaks. These operational problems associated with stickies result in excessive downtimes as a result of an increase in maintenance, cleaning, replacing equipment, and breaks. The issue with stickies not only affects the operational side of recycling but the quality of the product itself. On the product side, stickies can cause holes, sheet defects, high dirt count, and problems in converting which all cause an increase in breakages and rejects. Both problems reduce process efficiency and increase production costs and contribute to a decrease in machine productivity. Thus, there is a strong need to solve the stickies problem.

Current stickies control used in industry by its very nature just "cures the symptoms." This approach focuses on minimizing the effect of the stickies on the paper machine and in the final product. Current stickies control methods include passivation, dispersion, fixation, and detackification. In passivation, the stickies are stabilized through the use of an additive such as talc, bentonite, smectite, and other minerals as disclosed in U.S. Pat. Nos. 4,923,566; 5,798,023; 8,691,052; 8,840,761; and 9,017,519. Stickies control by dispersion is achieved through the use of anionic or nonionic dispersants. In terms of stickies control through fixation into the fibers, this is typically carried out using cationic polymers as described in U.S. Pat. No. 7,407,561. For stickies control via detackification, various chemical compounds, enzymes, and chemically structured minerals as disclosed in U.S. Pat. Nos. 4,886,575; 4,956,051; 5,080,759; 6,471,826; 8,048,268; 8,388,806; 8,784,606; 8,784,613; 9,057,155 are generally used. However, a method for stickies control in which stickies are removed from the product would be a superior solution than those presented in the prior art, because such a method would not involve the use of additional chemicals, polymers, dispersants or other additives, at an additional production cost, and would provide a more comprehensive solution to the paper quality problems caused by stickies rather than just masking their presence in the product.

U.S. Pat. No. 6,210,526 (to Pohlen) discloses a method of inhibiting and eliminating stickies from wastepaper through the addition of hydrophobized synthetic or natural mineral to a waste paper pulp wherein the stickies are removed together with the ink and dirt particles during flotation deinking. The hydrophobized synthetic or natural mineral is added in the form of a fiber containing slurry. The method disclosed by Pohlen only works in recycling operations that use flotation, which limits its application. For example, the recycling of paperboard does not use flotation, and so the Pohlen method would not be acceptable for stickies removal in such operations.

U.S. Pat. No. 5,540,814 (to Curtis et al.) describes a method of reducing stickies and removing ink from waste paper fiber wherein a cationic kaolin is added to a waste paper fiber under conditions such that the kaolin attaches to the stickies or the ink and the stickies or ink are then removed using a centrifugal cleaner due to the stickies or ink now having a higher specific gravity. The cationic kaolin is prepared from anionic kaolin and a cationic polymer, such as epicholorohydrin polymer, poly(dialkyldiallylammonium halide), poly(diallydimethylammonium chloride) or polyalkylester of a tertiary amine halide. However, the presence of cationic polymers significantly affects the wet end part of papermaking. In addition, the presence of cationic polymers in stock preparation where fractionation is used is detrimental to the separation of the long fiber from the short fiber. Thus, most paper and paperboard recycling operations avoid the use of any material in the recycling operation that contains cationic or anionic polymers. As such, the Curtis method also has limited use in certain stickies removal operations.

U.S. Pat. No. 6,013,157 (to Li et al.) discloses a chemical deinking agent for controlling froth and reducing stickies during flotation wherein the deinking agent consists from nonionic surfactant represented by the following formula:

$$R—C_6H_4O—(C_2H_4O)_m—(C_3H_8O)_n—(C_4H_8O)_p—R^1$$

fatty acid esters of sorbitan, certain alkoxylated fatty acid esters of sorbitan, polypropylene glycols, and a combination of at least two of the aforesaid materials. However, similar to the method disclosed by Pohlen, the Li method is limited to recycling operations that use flotation, and so this method would not be acceptable for stickies removal in operations that do not involve flotation.

U.S. Pat. No. 8,043,473 (to Yuzawa et al.) discloses a method of making deinked pulp using anhydride of crystalline layered silicate. This patent claims to improve the deinking of waste paper but prevents excessive reduction in the size of the stickies, resulting in a deinked pulp with reduced stickies content. However, the Yuzawa method is limited to deinking applications and requires deinking surfactants in order to be effective. In addition, this method is not applicable to the recycling of paperboard. Therefore, the Yuzawa method is not acceptable for certain stickies removal operations.

U.S. Pat. Nos. 8,052,837 and 8,815,051 (both to Basilio et al.) showed that a modified kaolin-based deinking reagent developed for use in the flotation deinking of recovered paper can improve the removal of inks, dirts, and other contaminants. In the current invention, this technology has been developed further to produce a modified kaolin-based composition for removing stickies from waste paper and paperboard which does not suffer from the drawbacks of prior art methods for stickies removal.

Moreover, many current methods of stickies removal, including those described by the Basilio U.S. Pat. Nos. 8,052,837 and 8,815,051, are not suitable for one additional means of stickies removal, that involving a wash deinking or "washing" process. The washing process is particularly useful for the removal of contaminants such as water-based inks, fillers, coating particles, fines and micro stickies, and is a more efficient process than other contaminant removal processes particularly for fine paper products like tissue. Washing involves a process whereby dispersants are added to the recycled paper/paperboard pulp, which is then dewatered or thickened to wash out unwanted (medium and fine) particles.

Some of the prior art reagents and methods using same that are described herein, including those described by Basilio, are not suitable for use in a washing process for contaminant removal because the use of these reagents causes excessive foaming, lowering the efficiency of the overall contaminant removal process. It would therefore be beneficial to have a composition that is suitable for use in a wider range of contaminant removal processes, including washing, flotation, and other processes known in the art.

SUMMARY OF THE INVENTION

The present invention provides a modified kaolin-based composition for the removal of stickies from waste paper and paperboard which shows an increased efficiency of the removal of stickies over existing methods.

In the present invention, this modified kaolin-based composition for the removal of stickies is prepared by dispersing the kaolin clay with chemical dispersants, treating the dispersed kaolin particles with modifying reagents, and separating the modified particles from the non-reactive particles. Only the particles that are modified are used in this invention, unlike the prior art that uses the entire kaolin particles without regard to their properties. The modified kaolin-based particles are then blended with a surfactant to produce a stickies removal composition that improves the separation of the stickies from the waste paper and paperboard fibers.

The modified kaolin-based particles demonstrate enhanced attachment to stickies over prior art methods, resulting in improvements in the amount of agglomeration of the stickies together with the modified kaolin-based particles. This results in increasing the particle size and the density of these stickies enabling the more efficient separation of these stickies from the fibers of the waste paper and paperboard in the fine screening and cleaning operations of paper recycling processes.

The removal of stickies through screening is based on particle size difference between the paper fiber and the stickies. In prior art methods, screening to remove stickies is inefficient since most of the stickies are too small to be removed even by the finest screens. Also, most of the stickies such as hot melts are semi-solid at typical operating temperatures during recycling, so under prior art methods these stickies are able to extrude and pass through holes and slots together with paper fiber. In the case of conventional centrifugal cleaning, the separation of stickies is based on the difference in the density between the stickies and the paper fiber. The prior art methods of removing stickies by centrifugal cleaning are also inefficient since the density of most stickies is very close to that of fiber. But by collecting and agglomerating the stickies with the modified kaolin-based composition of this invention to form bigger particles with a higher density, the present invention provides a means to make centrifugal cleaning more efficient in removing stickies. Finally, unlike many of the prior art methods and reagents, the modified kaolin-based composition of this invention is suitable for use with the washing process of removing stickies, whereby the pulp is mixed with dispersants and then dewatered to remove medium and fine stickies.

The current invention is different from the previous inventions disclosed by the present inventors in U.S. Pat. Nos. 8,052,837 and 8,815,051, as well as that disclosed by Pohlen (U.S. Pat. No. 6,210,526) and Li (U.S. Pat. No. 6,013,157) as the present invention is a method of removal of contaminants from waste paper that has broader applicability than those prior art methods which are only useful in contaminant removal processes that use flotation. In addition, the present invention differs from the Pohlen method as the composition of the present invention includes a surfactant to improve the separation of the stickies from the waste paper and paper board while that of Pohlen does not.

The current invention also overcomes the drawbacks present in the method disclosed in U.S. Pat. No. 5,540,814 to Curtis because the present method does not use the soluble cationic polymers disclosed by Curtis, which polymers are detrimental to the separation of long and short fibers in the papermaking operation. Specifically, the Curtis operation uses anionic kaolin that is treated with water soluble cationic polymers such as epicholorohydrin polymer, poly(dialkyldiallylammonium halide), poly(diallydimethylammonium chloride) or polyalkylester of a tertiary amine halide to form a cationic kaolin. In addition, the modified kaolin particles are separated from the non-reactive kaolin particle and are hence the only particles used in the present composition while the prior art uses all the cationic kaolin particles. Lastly, the current invention is different from the prior art in that there is no surfactant added to this cationic kaolin composition.

Finally, the present invention overcomes the drawbacks of the Yuzawa method because the present method does not require deinking surfactants, and is therefore applicable to a broader range of contaminant removal processes, such as the recycling of paperboard.

These and other objects, features and advantages of this invention will become apparent from the following detailed description.

DETAILED DESCRIPTION OF THE INVENTION

The present invention provides a stickies removal composition which comprises a modified kaolin-based component and a surfactant.

In accordance with the present invention, the kaolin clay particles are first dispersed into a slurry form and then mixed with a surface modifying agent to modify the surface of the kaolin clay particles.

The surface modifying agents that may be used to prepare the modified kaolin-based component include (but are not limited to) hydroxamates, fatty acids, sulfonates, amines, siloxanes, silanes, sulfhydryl, and blends of such agents. The modified kaolin-based particles are then concentrated and separated from the non-reactive kaolin-based particles.

Methods of separating the modified particles include flotation and selective flocculation. In the case of flotation, the modified particles are transferred to a flotation cell and floated. The modified kaolin-based particles after separation from the non-reactive kaolin-based material are then mixed with a surfactant to produce a modified kaolin-based composition that can be used as a stickies removal agent for improving the removal of stickies during the various operations of the paper recycling process.

Crude kaolin clay generally contains kaolinite and other related hydrated aluminum silicate minerals as well as quartz, mica, titanium dioxide and iron oxide minerals.

In a preferred embodiment, to produce the modified kaolin-based component of this invention, the starting crude kaolin clay is initially dispersed by blunging the clay with water in the presence of a dispersant at dosages ranging from about 1 to about 25 pounds per ton of dry solids. Effective dispersants include sodium silicate, sodium metasilicate, sodium hexametaphosphate, and sodium polyacrylate. The preferred dispersant for this invention is sodium silicate using dosages ranging from about 2 to about 16 pounds per ton of dry clay. The pH is adjusted to a range of about 5 to about 11, preferably about 7 to about 10, using a pH modifier such as sodium hydroxide, sodium carbonate or ammonium hydroxide.

The dispersed kaolin clay slurry is then mixed with a surface modifying reagent such as alkyl hydroxamate, fatty acid, siloxane, silane, or a combination of such reagents. The amount of surface modifying reagent added to the dispersed kaolin slurry must be sufficient to surface modify the crude kaolin clay. The surface modifying reagents used are in the range of about 0.2 to about 10 pounds per ton of dry clay, preferably about 0.5 to about 5 pounds per ton.

After mixing with the surface modifying reagent, the kaolin slurry is then transferred to a froth flotation cell and, if necessary, diluted to a pulp density preferably within the range of about 15% to about 45% solids by weight. The operation of the froth flotation machine is conducted in conventional fashion. After an appropriate period of operation, the surface modified kaolin clay particles are concentrated in the froth phase and collected.

In the production of the modified kaolin-based particles for the present invention, the froth flotation process can be conducted either in a mechanical or pneumatic machine. A typical pneumatic machine that can be used is a flotation column, while a typical mechanical machine is an impeller driven flotation machine. The modified material in this invention can also be produced by flotation through the use of other flotation processes such as dissolved air flotation, induced air flotation, bulk oil flotation, skin flotation or table flotation.

During the flotation process, the mineral components of kaolin that are reactive to the modifying reagents will be separated from the non-reactive mineral components of kaolin. Note that only the reactive mineral components of kaolin that have been modified by the modifying reagents are used to produce the modified kaolin-based component of this invention.

The hydroxamate agent used in the present invention is a hydroxamate compound, or a mixture of such compounds, having the general formula:

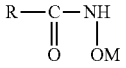

in which R is an alkyl, aryl or alkylaryl group having 4 to 28 carbon atoms, and M is hydrogen, an alkali metal or an alkaline earth metal.

Examples of suitable R groups include butyl, hexyl, octyl, dodecyl, lauryl, 2-ethylhexyl, oleyl, eicosyl, phenyl, tolyl, naphtyl and hexylphenyl.

Examples of suitable alkali metals are lithium, sodium and potassium.

Examples of suitable alkaline earth metals are magnesium, calcium and barium.

In this invention, the fatty acid used has the general formula:

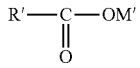

in which R' is an alkyl, aryl or alkylaryl group having 1 to 26 carbon atoms, and M' is hydrogen, an alkali metal or an alkaline earth metal.

Examples of suitable R' groups include methyl, ethyl, butyl, octyl, lauryl, 2-ethylhexyl, oleyl, eicoseyl, phenyl, naphtyl and hexylphenyl.

Examples of suitable alkali metals are lithium, sodium and potassium.

Examples of suitable alkaline earth metals are magnesium, calcium and barium.

The siloxanes used in the present invention are organosilane compounds containing a silicon to carbon bond. Examples of suitable siloxanes include hexamethyldisiloxane, hexamethylytrisiloxane, disiloxane, vinylbeptamethyltrisiloxane, octamethyltrisiloxane, tetramethyldisiloxane, tetravinyldimethyldisiloxane, polydimethylsiloxanes, polymethylhydrosiloxanes, polyethylhydrosiloxanes and polymethylalkylsiloxanes.

The silanes used in the present invention are inorganic compounds with the general formula:

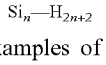

Examples of suitable silanes are methyltriethoxysilane, octyldimethylchlorosilane, methyltris(methoxyethoxy)silane, octyltrichlorosilane, and phenyltrimethoxysilane.

A nonionic surfactant is then blended with the modified kaolin-based particles to produce the modified kaolin-based composition for removing stickies of this invention. The nonionic surfactants used in this invention can be any of those which is known in the industry for similar applications. Examples of suitable surfactants are fatty acid ethoxylates, fatty alcohol ethoxylates, castor oil ethoxylates, polyethylene glycol esters, and polypropylene glycol esters.

The inventive composition comprising the modified kaolin-based particles, produced as described herein, and a nonionic surfactant may then be used in contaminant removal methods known in the art of waste paper and waste paperboard processing, including centrifugation, flotation, deinking, washing, screening/fine screening, etc. In these methods, the inventive composition is added to a pulp or slurry comprising waste paper or paperboard including but not limited to old newspaper (ONP), old magazine (OMG), mixed office waste (MOW), sorted white ledger (SWL), sorted office paper (SOP), and old corrugated carton (OCC). Typically, the waste paper/paperboard slurry is formed from mixing waste paper/paperboard materials with a liquid comprising water and sometimes additional chemicals to assist in breakdown of the starting waste product. The waste paper pulp may further be heated and/or chopped to further aid in the breakdown of the raw waste material. The inventive composition described herein may be added with the liquid to form the pulp/slurry (or may be incorporated therein) or may be added after any of the operations described herein, i.e. slurry formation, chopping, and/or heating. The waste paper pulp and inventive composition mixture may then be subjected to any of the known means of stickies removal described herein, namely centrifugation, flotation, washing, deinking, screening/fine screening, or the like, but is preferably subject to a centrifugation process to remove the stickies which now have a higher specific gravity due to their bond with the inventive kaolin composition described herein. In other preferred embodiments, the waste paper pulp and inventive composition mixture is subjected to a screening operation where stickies are removed due to their larger size owing to their bond with the inventive kaolin composition described herein. Also as noted above, the inventive composition has a particular advantage in the washing process of contaminant removal, in that the inventive composition does not generate excessive foam during the washing process, and so in other preferred embodiments, the waste paper pulp and inventive composition mixture is subjected to a washing process.

The inventive composition described herein may be used in a concentration of roughly 0.2 to 20 pounds of composition per dry ton of waste paper/paperboard starting product, but is preferably used in a concentration of 1-5 pounds per dry ton of waste paper/paperboard starting product, and most preferably used in a concentration of 1-2 pounds per dry ton of waste paper/paperboard starting product.

The present invention is further illustrated by the following examples which are illustrative of certain embodiments designed to teach those of ordinary skill in this art how to practice this invention and to represent the best mode contemplated for carrying out this invention.

Example 1

A sample of kaolin clay from Washington County, Ga. was modified and the modified kaolin-based material is then separated from the non-reactive kaolin-based material using the following procedure.

2000 dry grams of a crude kaolin clay sample were blunged using a high speed mixer. Blunging of the clay was conducted at 62% solids using 7 pounds sodium silicate per ton of dry clay and 1.5 pounds sodium hydroxide per ton of dry clay. The dispersed kaolin clay was then modified with the following reagents: 1 pound alkyl hydroxamate per ton of dry clay, 1 pound tall oil per ton of dry clay and 0.5 pound calcium chloride per ton of dry clay as activator for tall oil. The treated material was diluted to 25% solids with water and then transferred to a Denver D-12 flotation cell. The slurry was then floated to separate the modified mineral components in kaolin from the non-reactive mineral components in the kaolin clay. The modified kaolin-based material was then collected in the froth phase. This material was then dewatered to remove some of the water present in the collected slurry.

The modified kaolin-based material produced in Example 1 is used as the modified kaolin-based stickies removal component, which is then blended with a nonionic surfactant to produce the modified kaolin-based stickies removal agent composition of this invention.

Table 1 shows the differences in the properties of the starting kaolin clay, the non-reactive kaolin-based material, the modified kaolin-based stickies removal component and the modified kaolin-based stickies removal composition. As shown, the modified kaolin-based stickies removal component and the modified kaolin-based stickies removal composition are different from the kaolin clay starting material and the non-reactive kaolin-based material in particle size distribution and chemical composition. The modified kaolin-based stickies removal component and modified kaolin-based stickies removal composition have a coarser particle size distribution with fewer particles finer than 2 microns compared to the starting kaolin clay and the non-reactive kaolin-based material. The chemical composition of the modified kaolin-based stickies removal component and modified kaolin-based stickies removal composition as analyzed by X-ray fluorescence have lower amounts of aluminum and silicon oxides but higher amounts of titanium and iron oxides compared to the starting kaolin clay and non-reactive material.

In addition, due to the blunging of the crude kaolin clay in the presence of a dispersant such as sodium silicate and its pH adjusted to about pH 5 to 11 with a pH modifier such as sodium hydroxide, the resulting modified kaolin-based stickies removal component and modified kaolin-based stickies removal composition are different because the dispersants have modified the surface property of kaolin which now has the dispersant adsorbed on its surface. The crude kaolin clay does not naturally have these adsorbed dispersant chemicals on its surface. In addition, the modified kaolin-based stickies removal component and modified kaolin-based stickies removal composition contain the modifying reagents such as alkyl hydroxamate on their surfaces (see Table 1). These differences allow the modified kaolin-based stickies removal composition to be effective in removing stickies from waste paper and paperboard.

TABLE 1

| | Alkyl Hydroxamate | Particle Size Distribution, % Passing | | | | XRF Chemical Analysis | | | | |
|---|---|---|---|---|---|---|---|---|---|---|
| Material | Content, ppm | 2 μm | 1 μm | 0.5 μm | 0.2 μm | $Al_2O_3$ | $SiO_2$ | $TiO_2$ | $Fe_2O_3$ | Si/Al Ratio |
| Kaolin Clay | 0 | 59 | 45 | 29 | 15 | 37.8 | 44.7 | 1.6 | 0.4 | 1 |
| Non-Reactive Kaolin-Based Material | 0 | 61 | 48 | 32 | 14 | 38.8 | 45.6 | 0.3 | 0.3 | 1 |
| Modified Kaolin-Based Stickies Removal Component | 63 | 15 | 6 | 4 | — | 28.3 | 31.1 | 26.4 | 0.9 | 0.93 |
| Modified Kaolin-Based Stickies Removal Composition | 42 | 15 | 6 | 4 | — | 28.3 | 31.1 | 26.4 | 0.9 | 0.93 |

Example 2

The fine screening test procedure used in this work is as follows:

300 gm of old corrugated cardboard (OCC) was shredded and then mixed with hot tap water to 5% solids. The kaolin clay used as the starting material in Example 1 is added here at the rate of 1 pound of kaolin clay per dry ton of OCC. The sample was pulped for 10 minutes in a laboratory pulper. After pulping, the sample was diluted to 1% solids and screened using a fine screen having slots of 0.006". After screening, the refuse containing the stickies was collected and the amount of stickies removed by fine screening was measured. For the stickies measurement, the stickies were separated from the fiber using a Pulmac Masterscreen and then quantified using the Transparency Film Lamination method. The Pulmac Sticky Scan 200 was used for the quantification of the stickies amount through image analysis. The results are given in Table 2.

In other embodiments, the raw recycled paper product may be shredded and mixed with tap water to a different percentage of solids than that used herein for OCC. The percentage solids may be dictated by the application, and could be anywhere from 2 to 25% solids depending on the starting product.

Example 3

The fine screening test procedure used in Example 2 was repeated on an OCC sample. In Example 3, 1 pound of the non-reactive kaolin-based material produced in Example 1 per dry ton of OCC was used instead. The results of the laboratory screening test are presented in Table 2.

Example 4

Another fine screening test was conducted using the same fine screening test procedures used in Example 2 on an OCC sample. For this test (Example 4), 1 pound of the modified kaolin-based stickies removal component produced in Example 1 per dry ton of OCC was used instead. Table 2 shows the results of the laboratory screening test.

Example 5

The procedure used for the laboratory fine screening test used in Example 2 was repeated using 1 pound of the modified kaolin-based stickies removal composition, including the herein described modified kaolin-based stickies removal component with the addition of a nonionic surfactant, produced in Example 1, per dry ton of OCC. The results of the screening test are presented in Table 2.

As shown, the starting kaolin clay material, the non-reactive kaolin-based material produced from the kaolin clay in Example 1 and the modified kaolin-based stickies removal component produced in Example 1 did not remove any stickies. When the nonionic surfactant was added to the modified kaolin-based stickies removal component to produce the modified kaolin-based stickies removal composition, the use of this composition resulted in significant stickies removal.

TABLE 2

| Material Used as Stickies Removal Reagent | Amount of Stickies Removed, ppm |
|---|---|
| Kaolin Clay | 0 |
| Non-Reactive Kaolin-Based Material | 0 |
| Modified Kaolin-Based Stickies Removal Component | 0 |
| Modified Kaolin-Based Stickies Removal Composition | 36 |

This invention has been described in detail with particular reference to certain embodiments, but variations and modifications can be made without departing from the spirit and scope of the invention as defined in the following claims.

What is claimed is:

1. A method of removing stickies particles from waste paperboard, the method comprising:

forming a pulp of waste paperboard product;

adding a composition comprising a nonionic surfactant and a modified kaolin-based stickies removal component to said pulp to form a mixture; and subjecting said mixture to a stickies removal operation, wherein said stickies removal operation is selected from the group comprising centrifugation or screening;

wherein said nonionic surfactant is selected from a group comprising polyethylene glycol esters, polypropylene glycol esters or blends thereof.

2. The method of claim 1, wherein said stickies removal operation comprises centrifugation.

3. The method of claim 1, wherein said stickies removal operation comprises screening.

4. The method of claim 1, wherein said stickies removal operation does not include flotation.

5. The method of claim 1, wherein said mixture comprises said composition in a concentration of from 0.2 to 20 pounds of composition per dry ton of waste paperboard in said pulp.

6. The method of claim 5, wherein said mixture comprises said composition in a concentration of 1-2 pounds of composition per dry ton of waste paperboard in said pulp.

7. The method of claim 1, wherein said modified kaolin-based stickies removal component is produced by a process which comprises:

forming a slurry of dispersed kaolin clay particles;

treating the dispersed kaolin clay particles with a modifying reagent; and separating the modified kaolin-based particles from the non-reactive kaolin-based particles.

8. The method of claim 7, wherein the modifying reagent is selected from a group comprising a fatty acid, hydroxamate, sulfonate, amine, siloxane, silane, sulfhydryl, or blends thereof.

9. The method of claim 1, wherein said pulp is formed by a process comprising:

shredding said waste paperboard product to form a shredded waste product; and mixing said shredded waste product with hot tap water.

* * * * *